US008734200B2

(12) United States Patent
Payne et al.

(10) Patent No.: US 8,734,200 B2
(45) Date of Patent: May 27, 2014

(54) TOY PLAYSET WITH A LAUNCHER AND A MATERIAL DISPENSER

(75) Inventors: Julian Payne, Los Angeles, CA (US); Robert Matthes, Long Beach, CA (US); Tsz Ho Au, Kowloon (HK); Kam Wah Wei, Taikoo Shing (HK)

(73) Assignee: Mattel, Inc., El Segundo, CA (US)

( * ) Notice: Subject to any disclaimer, the term of this patent is extended or adjusted under 35 U.S.C. 154(b) by 69 days.

(21) Appl. No.: 12/767,621

(22) Filed: Apr. 26, 2010
(Under 37 CFR 1.47)

(65) Prior Publication Data

US 2010/0304639 A1 Dec. 2, 2010

Related U.S. Application Data

(60) Provisional application No. 61/172,581, filed on Apr. 24, 2009.

(51) Int. Cl.
*A63H 18/16* (2006.01)

(52) U.S. Cl.
USPC ..... 446/444; 446/14

(58) Field of Classification Search
USPC ..... 446/174, 433, 444, 465, 475, 166, 267, 446/429, 483
See application file for complete search history.

(56) References Cited

U.S. PATENT DOCUMENTS 4,045,908 A 9/1977 Ensmann
4,356,657 A 11/1982 Goldfarb et al.
4,519,789 A 5/1985 Halford et al.
4,558,867 A * 12/1985 Hippely ..... 273/412
4,725,462 A 2/1988 Kimura
4,818,215 A 4/1989 Taga
4,917,643 A 4/1990 Hippely et al.
4,961,716 A 10/1990 Hippely et al.
5,011,445 A 4/1991 Nakasuji et al.
5,085,607 A 2/1992 Shibahashi et al.
5,202,677 A 4/1993 Parker et al.
5,223,958 A 6/1993 Berry
5,282,651 A 2/1994 Alonso
5,316,513 A 5/1994 Nakagawa et al.
5,375,271 A 12/1994 Frankel (Continued)

FOREIGN PATENT DOCUMENTS

ES 2015663 9/1990
GB 2092463 8/1982

(Continued)

OTHER PUBLICATIONS

Mattel, Inc; "Mattel Color FX Catalog p. 21 Paint Works Paint Shop"; 1994; one page.

(Continued)

*Primary Examiner* — Gene Kim
*Assistant Examiner* — John E Simms, Jr.
(74) *Attorney, Agent, or Firm* — Kolisch Hartwell, PC

(57) ABSTRACT

In some examples, a toy vehicle playset for a toy vehicle is provided with a track assembly including a vehicle launcher operatively connected to a track. The track defines a travel path, and there is a dispensing assembly including a release mechanism positioned adjacent a portion of the track. A trigger assembly is operably connected to the vehicle launcher and the release mechanism so that activation of the trigger assembly may simultaneously activate the vehicle launcher and the release mechanism.

17 Claims, 4 Drawing Sheets

(56) References Cited

U.S. PATENT DOCUMENTS

| | | | | |
|---|---|---|---|---|
| 5,389,093 | A | 2/1995 | Howell | |
| 5,482,373 | A | 1/1996 | Hutchinson | |
| 5,502,967 | A | 4/1996 | Nakagawa et al. | |
| 5,503,583 | A | 4/1996 | Hippely et al. | |
| 5,586,923 | A * | 12/1996 | Hippely et al. | 446/14 |
| 5,643,040 | A | 7/1997 | Hippely et al. | |
| 5,716,253 | A | 2/1998 | Aoki et al. | |
| 5,743,185 | A | 4/1998 | Hippely et al. | |
| 5,786,838 | A | 7/1998 | Steinhauser et al. | |
| 5,816,887 | A * | 10/1998 | Rudell et al. | 446/456 |
| 5,871,385 | A * | 2/1999 | Hippely et al. | 446/424 |
| 5,899,789 | A | 5/1999 | Rehkemper et al. | |
| 6,196,241 | B1 | 3/2001 | Doolan | |
| 6,241,573 | B1 | 6/2001 | Ostendorff et al. | |
| 6,312,311 | B1 * | 11/2001 | Wilhelm et al. | 446/483 |
| 6,322,416 | B1 | 11/2001 | Burke | |
| 6,346,024 | B1 | 2/2002 | Engel | |
| 6,450,277 | B1 | 9/2002 | Kargilis et al. | |
| 6,468,088 | B1 | 10/2002 | Fujita et al. | |
| 6,478,654 | B1 | 11/2002 | Rehkemper et al. | |
| 6,585,555 | B2 | 7/2003 | Wong et al. | |
| 6,663,464 | B2 | 12/2003 | Payne et al. | |
| 6,676,480 | B2 | 1/2004 | Sheltman | |
| 6,780,127 | B2 | 8/2004 | Kennedy, III | |
| 6,951,497 | B1 | 10/2005 | Ngan | |
| 6,986,719 | B2 | 1/2006 | Kennedy | |
| 7,070,518 | B2 | 7/2006 | Kennedy | |
| 7,189,133 | B2 | 3/2007 | Harata et al. | |
| 7,258,073 | B2 | 8/2007 | McGuire | |
| 7,278,369 | B2 | 10/2007 | Kelley et al. | |
| 7,628,673 | B2 * | 12/2009 | Bedford et al. | 446/444 |
| 7,819,720 | B2 * | 10/2010 | Nuttall et al. | 446/444 |
| 7,901,266 | B2 * | 3/2011 | Ostendorff | 446/429 |
| 7,934,970 | B2 * | 5/2011 | O'Connor | 446/6 |
| 2003/0087580 | A1 | 5/2003 | Shibahashi | |
| 2004/0004069 | A1 | 1/2004 | Lerner | |
| 2005/0178314 | A1 | 8/2005 | McGuire | |
| 2006/0099879 | A1 * | 5/2006 | McGrath | 446/236 |
| 2006/0286896 | A1 * | 12/2006 | Bedford et al. | 446/444 |
| 2007/0128969 | A1 | 6/2007 | Shrock | |
| 2007/0259593 | A1 | 11/2007 | Imai | |
| 2008/0009224 | A1 | 1/2008 | Nuttall | |
| 2008/0070474 | A1 * | 3/2008 | Nuttall | 446/444 |

FOREIGN PATENT DOCUMENTS

| | | |
|---|---|---|
| GB | 2205255 | 12/1988 |
| GB | 2318323 | 6/1995 |
| GB | 2292323 | 2/1996 |
| GB | 2310283 | 8/1997 |
| GB | 2316385 | 2/1998 |
| GB | 2367479 | 4/2002 |
| JP | 7223397 | 8/1995 |
| JP | 11315277 | 11/1999 |
| JP | 2001149666 | 6/2001 |
| JP | 2008264113 | 11/2008 |
| WO | 8908486 | 9/1989 |

OTHER PUBLICATIONS

Mattel, Inc; "Mattel Color FX Catalog p. 40"; 1995; one page.

Mattel, Inc; "Mattel Catalog Matchbox Buried Treasure Rocks"; 2005; one page.

Mattel, Inc; "Mattel Instructions Matchbox Buried Treasure Rocks"; 2005; four pages.

* cited by examiner

TOY PLAYSET WITH A LAUNCHER AND A MATERIAL DISPENSER

RELATED APPLICATION(S)

This application claims priority under 35 U.S.C. §119(e) to U.S. Provisional Patent Application Ser. No. 61/172,581, which was filed on Apr. 24, 2009 and is entitled "TOY TRACK SET WITH A WATER TANK". The complete disclosure of the above-identified patent application is hereby incorporated by reference for all purposes.

BACKGROUND

Toy playsets and accompanying toys are a source of entertainment for children. Toy playsets having different features may increase the enjoyment of children using the playsets. For example, the toy playset may include a launcher and a dispenser for dispensing a fluid material on the playset. Additionally and/or alternatively, the toy playset may feature a toy vehicle track set. Some toy playsets may be configured for use with a thermochromatic toy that changes color upon exposure to hot or cold material.

The present disclosure is directed generally to toy playsets and, more particularly, to playsets with a launcher and one or more with one or more dispensers for a fluid material, such as water, configured for release on a toy and/or toy track set. Examples of track sets and/or toys are disclosed in U.S. Pat. Nos. 4,045,908; 4,356,657; 4,519,789; 4,725,462; 4,818,215; 4,917,643; 4,961,716; 5,011,445; 5,085,607; 5,202,677; 5,223,958; 5,282,651; 5,316,513; 5,375,271; 5,389,093; 5,482,373; 5,502,967; 5,503,583; 5,586,923; 5,643,040; 5,716,253; 5,743,185; 5,786,838; 5,871,385; 5,899,789; 6,196,241; 6,241,573; 6,312,311; 6,322,416; 6,346,024; 6,450,277; 6,468,088; 6,478,654; 6,585,555; 6,663,464; 6,676,480; 6,780,127; 6,951,497; 6,986,719; 7,070,518; 7,189,133; 7,258,073; 7,278,369; U.S. Patent Application Nos. U.S. 20030087580; U.S. 20040004069; U.S. 20050178314; U.S. 20070128969; U.S. 20070259593; U.S. 20080009224; U.S. 20080070474; and Foreign Patent Nos. ES2015663; GB2092463; GB2205255; GB2292323; GB2310283; GB2315685; GB2367479; JP07223397; JP11315277; JP2001149666; JP0007223397; JP2008264113; W089084861. The disclosures of all the above-referenced patents are incorporated herein by reference in their entirety for all purposes.

SUMMARY

In some examples, a toy vehicle playset for a toy vehicle is provided, comprising a track assembly including a vehicle launcher operatively connected to a track defining a travel path, a dispensing assembly including a release mechanism positioned adjacent a portion of the track and a trigger assembly operably connected to the vehicle launcher and the release mechanism. Activation of the trigger assembly may simultaneously activate the vehicle launcher and the release mechanism.

In some examples, a toy playset for a thermochromatic toy is provided, comprising a toy launcher configured to launch a thermochromatic toy along a travel path, a dispenser adjacent the travel path configured to releasably retain color changing material, and a trigger operably connected to the toy launcher and the dispenser. Activation of the trigger may simultaneously launch the thermochromatic toy along the travel path and release the color changing material from the dispenser into the travel path.

In some examples, a toy vehicle playset for a toy vehicle is provided, comprising a track assembly including a vehicle launcher activatable to launch a toy vehicle. The launcher may be attached to a track defining a travel path for a toy vehicle. The toy vehicle playset may further comprise a water dispenser including a tank and a support assembly for supporting the tank above the track. The tank may have a moveable release member at a bottom portion of the tank. The vehicle launcher and the moveable release member may be configured to be activated simultaneously.

DETAILED DESCRIPTION

Figure 1:
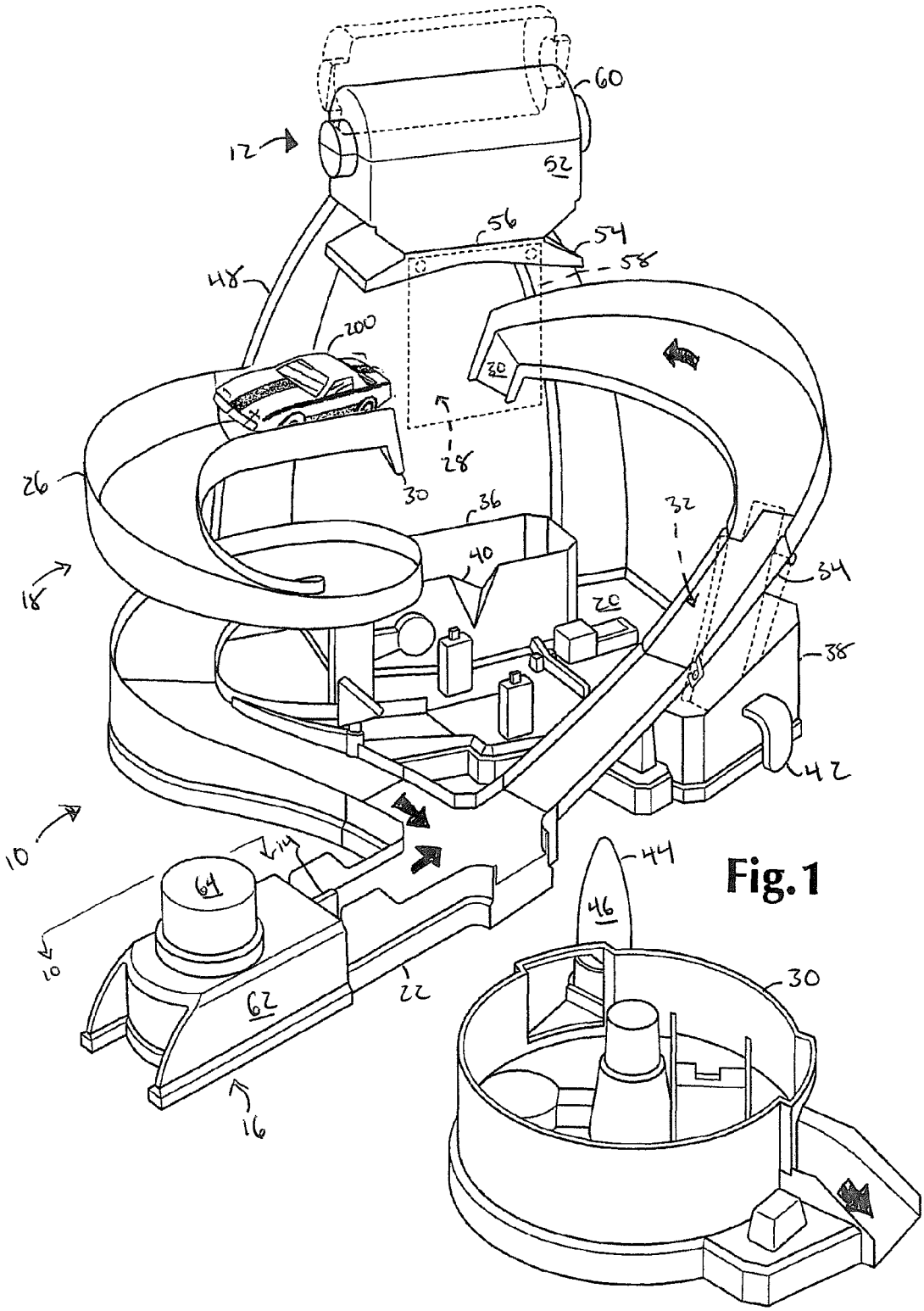
FIG. 1 is a perspective view of a nonexclusive illustrative example of a playset in accordance with the present disclosure.

FIG. 1 sets forth a perspective view of a toy playset constructed in accordance with the present invention and generally referenced by numeral 10. Playset 10 includes a dispenser assembly 12 and a launcher 14, also referred to as a vehicle launcher. Playset 10 further includes a trigger assembly 16 operably connected to launcher 14 and dispenser assembly 12, wherein activation of trigger assembly 16 simultaneously activates launcher 14 and dispenser assembly 12.

A particularly fun play pattern using playset 10 includes a thermochromic toy that changes color as it flies through hot or cold fluid material released from dispenser assembly 12, such as hot or cold water or other color changing material. By decorating one or more surface areas on the toy with thermochromic ink, also known as thermochromatic ink, such as inks made by Pilot Ink in Japan, a near instantaneous and quite magical color change may be created as the toy flies through the water, even if the toy is moving very fast. Triggering the start of the water release to match the launch of the toy insures that ample water is available at the time the toy is most likely to be travelling through the released water.

The embodiment of the playset shown in FIGS. 1-10 is configured for use with a toy vehicle 200 and includes a track assembly 18, supported on a base 20, however, other embodiments in accordance with the present disclosure may be configured for use without a track assembly and/or with other toys including such nonlimiting examples as toy balls, toy airplanes, action figures, and dolls.

As best seen in FIG. 1, track assembly 18 may include a track segment 22 adjacent launcher 14. A first track loop segment 24 may be coupled at one end to track segment 22 and may form a partial loop extending upwardly into alignment with a second track loop segment 26 on the opposite side of a first opening 28 in track assembly 18. First opening 28 may be further defined by downwardly extending splash guards 30. Second track loop segment 26 may define a complete and/or partial loop and may be coupled at one end to track segment 22.

Some embodiments of playset 10 may further include a toy vehicle catcher, such as spin dry assembly 30. The spin dry assembly 30 may be operable to receive toy vehicle 200 and retain it while it is spun dry. When spinning is completed, the spin dry assembly 30 may be operable to position toy vehicle 200 for discharge from playset 10. Toy vehicle catcher 100 is shown spaced from track segment 22 in FIG. 1, however, it may be configured for attachment to track segment 22 using a tab that mates with a corresponding slot, as is known in the art.

Track assembly 18 may further include a second opening 32 approximately sized such that toy vehicle 200 can pass through. A trapdoor 34 may be hingedly attached to the track assembly 18 and may be movable between a closed position in which trapdoor 34 is positioned in the second opening and aligned with and forms a part of track assembly 18, and an open position (shown in dashed lines in FIG. 1) in which trapdoor 34 is removed from second opening 32. Trapdoor 34 may be approximately the size of second opening 32 to support toy vehicle 200 when trapdoor 34 is in the closed position.

Playset 10 may include a first reservoir 36 positioned below first opening 28 and/or a second reservoir 38 positioned below second opening 32. First and second reservoir 36, 38 may be detachable from playset 10 and may be used to fill dispenser assembly 12 and/or hold fluid material. For example, first and/or second reservoir 36, 38 may include a curved lip portion 40 and/or a handle 42 to facilitate pouring water.

Playset 10 may further include accessories for use with playset 10. For example, playset 10 may include a pen 44 having an elongated chamber 46 configured to hold water, a valve and a foam tip, such that a user can fill pen 44 with water and squeeze to decorate toy vehicle 200. Toy vehicle catcher 30 may define one or more tool receptacles which receive and support a plurality of alternative tools, such as pen 44, for convenient access and storage.

Dispenser assembly 12 may be supported above first opening 28 in track assembly 18 by a first support member 48 and a second support member 50 and may be configured to releasably support quantities of material capable of fluid motion, including, but not limited to, water, compressed air, confetti, and/or glitter into the travel path of a launched toy and/or track assembly 18. Accordingly, dispenser assembly 12 may be distal launcher 14 and adjacent a portion of the travel path of the launched toy vehicle and/or track assembly 18.

Dispenser assembly 12 may include a dispenser 52, also referred to as a tank or a hopper. A cascade member 54 may be joined to a lower portion 56 of dispenser 52. Dispenser assembly 12 may further include a splash guard 58 adjacent dispenser 52 to minimize dispersement of fluid material around playset 10. A lid 60 may be hingedly joined to dispenser 52 having an open position (shown in relief in FIG. 1) and a closed position. Dispenser assembly 12 may include a release mechanism discussed in further detail with respect to FIGS. 4-9.

Turning now to FIGS. 1-3 and 10, as explained earlier, trigger assembly 16 may be operably connected to both launcher 14 and dispenser assembly 12. Trigger assembly 16 may extend from launcher 14 to dispenser assembly 12 through a housing 62, a portion of track assembly 18, such as track segment 22, base 20 and/or first support member 48. A user activatable button 64 or trigger may be adjacent launcher 14 and distal dispenser assembly 12. Activation of trigger 64 may activate launcher 14 and dispenser assembly 12.

Figure 10:
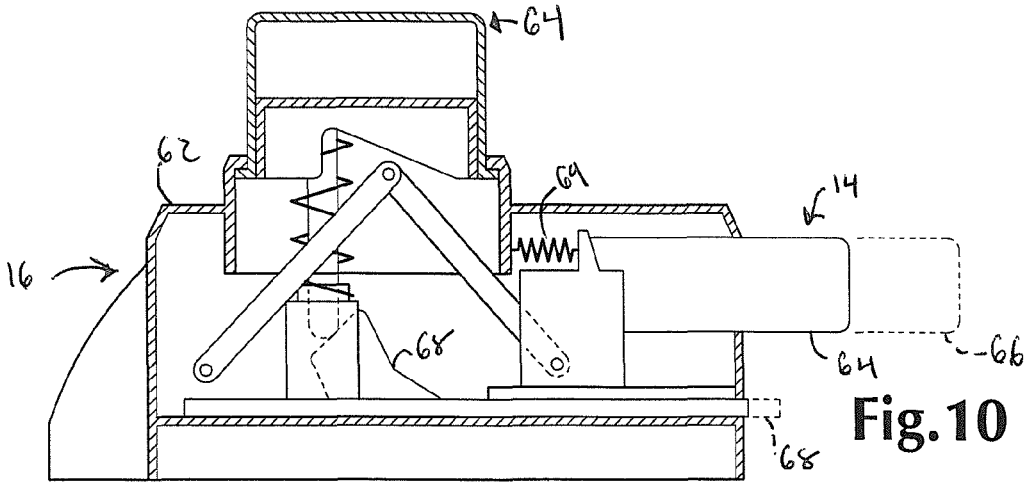
FIG. 10 is a section view of a portion of the trigger assembly and a launcher of FIG. 1, taken generally along line 10-10 in FIG. 1, showing the ready-to launch position and the launched position.

As best seen in FIG. 10, launcher 14 may be partially supported within housing 62 and may have a ready-to-be launched position 64 and a launched position 66. Trigger assembly 16 may be operably connected to launcher 14 via one or more biased housing trigger members, wherein activation or compression of trigger 64 causes the one or more biased housing trigger members to laterally move launcher 14 from ready-to-be launched position 64 to launched position 66. For example, launcher 14 may be at least partially supported by a housing trigger platform 68 and compression of trigger 64 may cause housing trigger platform 68 and launcher 14 to move laterally. Housing trigger platform 68 may be biased via one or more biasing member, such as a spring 69.

Figure 2:
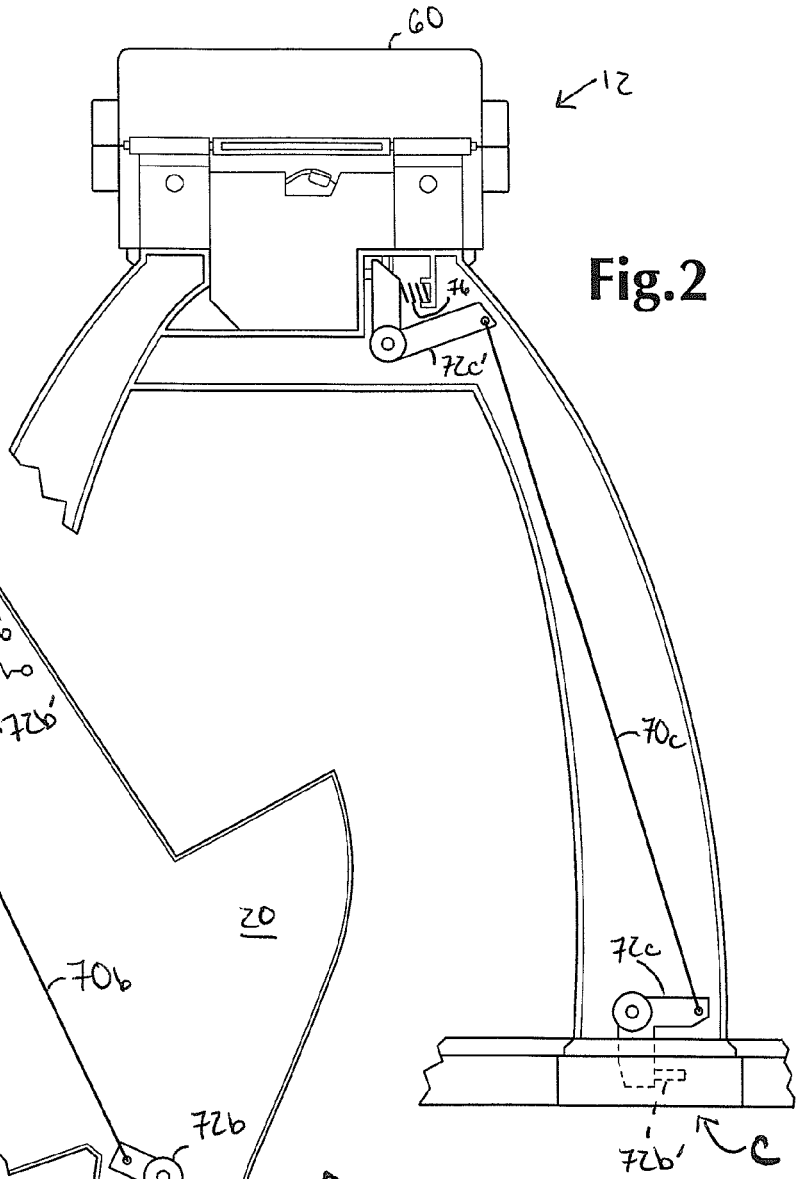
FIG. 2 is a partial rear view of the playset of FIG. 1, showing a portion of a trigger assembly in accordance with the present disclosure.
Figure 3:
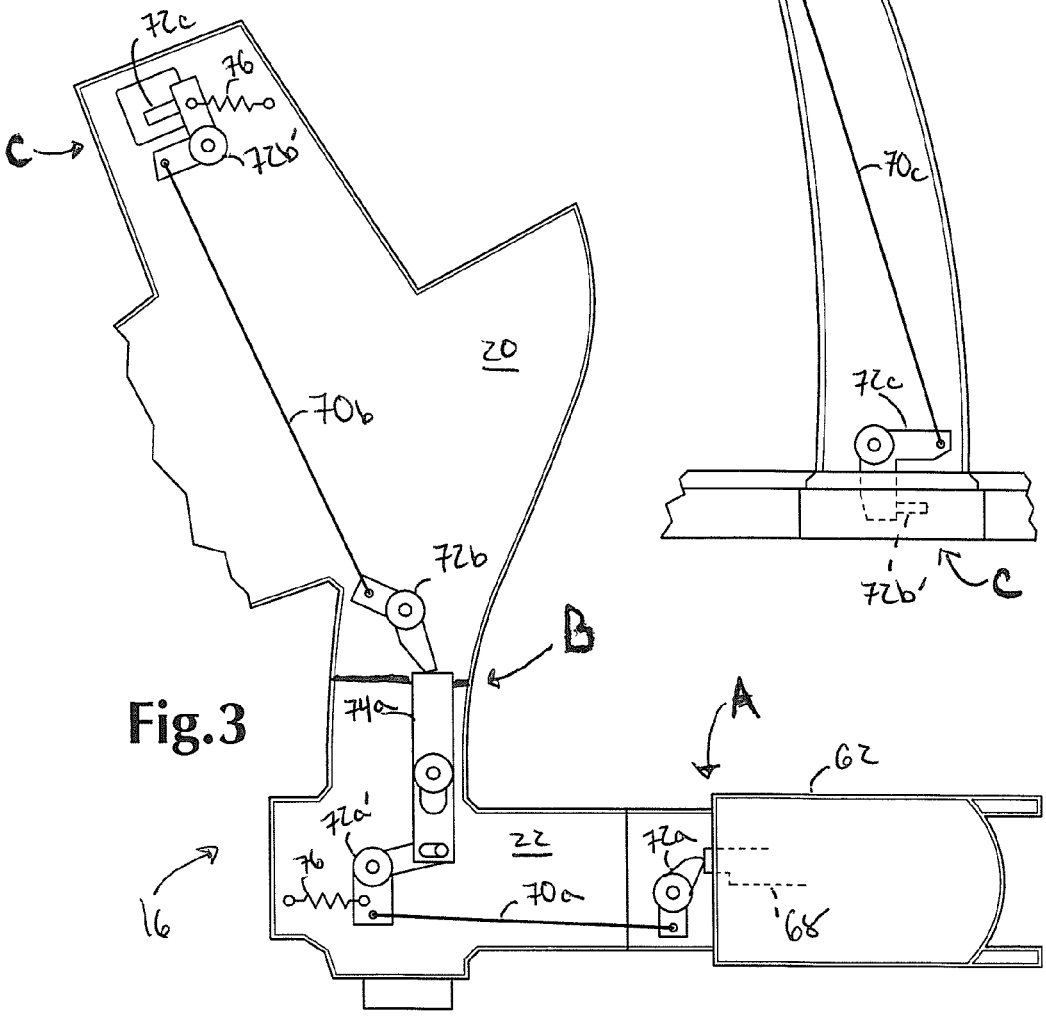
FIG. 3 is a partial underside view of the playset of FIG. 1, showing a portion of a trigger assembly in accordance with the present disclosure.

Turning now to FIGS. 2 and 3, one or more of housing trigger members, such as housing trigger platform 68, may be operably connected to a moveable series of trigger assembly members supported within track segment 22, base 20 and first support member 48. For example, trigger assembly members may include trigger rods 70, pivotable trigger arms 72 and/or laterally moveable trigger elements 74, one or all of which may be biased by one or more biasing members 76. The combination of one pivotable trigger arm 72, one laterally moveable trigger element 74, and one biasing member 76 is particularly useful for playsets that may be assembled and disassembled, because pivotable trigger arm 72 and biasing member 76 may be contained in a first housing, and laterally moveable trigger element 74 may be contained in an adjacent second housing that is removably attached to the first housing. Similar motion-transfer mechanisms may include a first pivotable trigger arm 72 be contained in a first housing, and a second pivotable trigger arm 72 be contained in an adjacent second housing that is removably attached to the first housing.

For example, housing trigger platform 68 may operably connect to a track trigger arm **72*a* across point A between housing 62 and track segment 22. Track trigger arm 72*a* may be operably connected to a track trigger element 72*a* via a track trigger rod 70*a* and a second track trigger arm 72*a*', all contained within track segment 22**.

Laterally moveable track trigger element **72*a* may operably connect to a base trigger arm 72*b* across point B between track segment 22 and base 20. Base trigger arm 72*b* may be operably connected to a second base trigger arm 72*b*' via a base trigger rod 70*b***.

Second base trigger arm **72*b*' may operably connect to a support trigger arm 72*c* across point C between base 20 and support member 48. Support trigger arm 72***c* may be operably connected to a second support trigger arm 72*c*' via a support trigger rod 70*c*.

Turning now to FIGS. 4-9, trigger assembly 16 may be operably connected to dispenser assembly 12 having a release mechanism 80, such that activation of trigger assembly 16 causes activation of release mechanism 80. Release mechanism 80 may include a release member or stopper 96 at the bottom portion 56 of dispenser 52, wherein movement of stopper 96 releases any fluid material content in dispenser 52.

Figure 4:
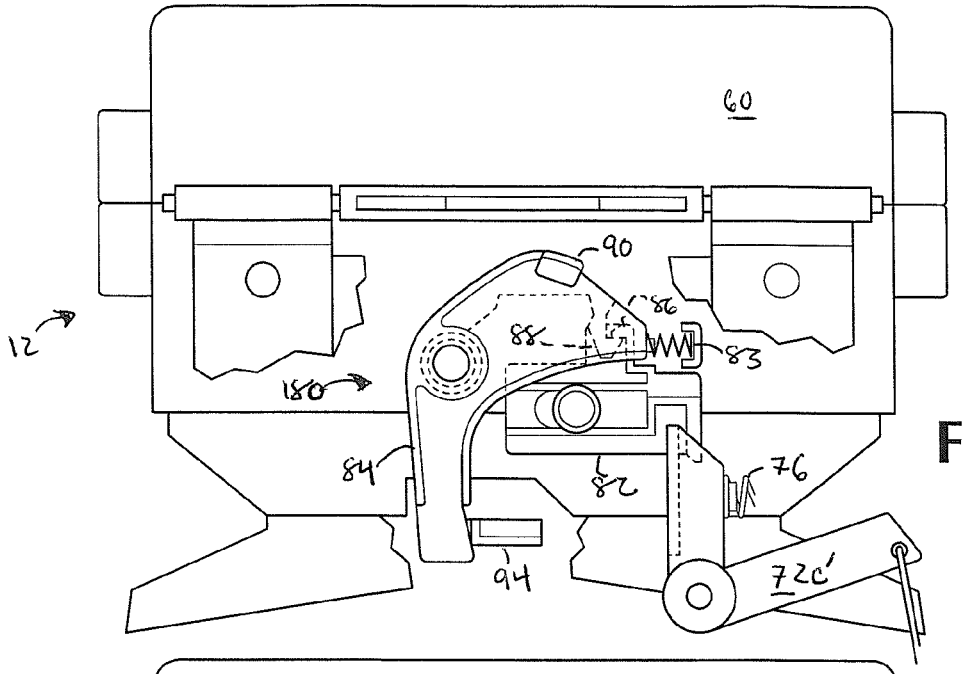
FIG. 4 is a rear view of a dispensing assembly in accordance with the present disclosure, showing a portion of a release mechanism in a closed position.
Figure 5:
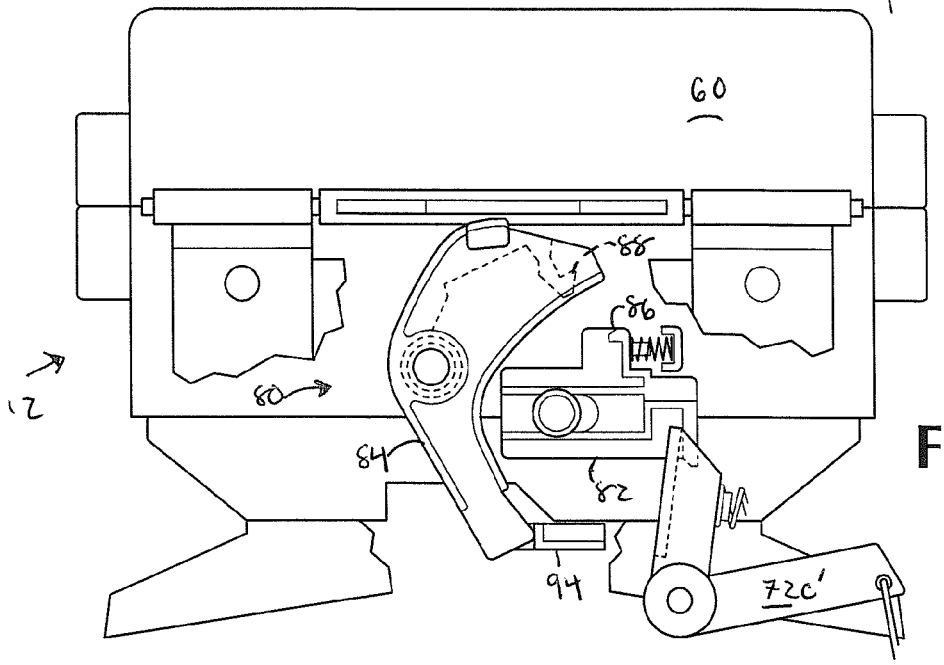
FIG. 5 is a rear view of the dispensing assembly of FIG. 4, showing a portion of the release mechanism in an open position.
Figure 6:
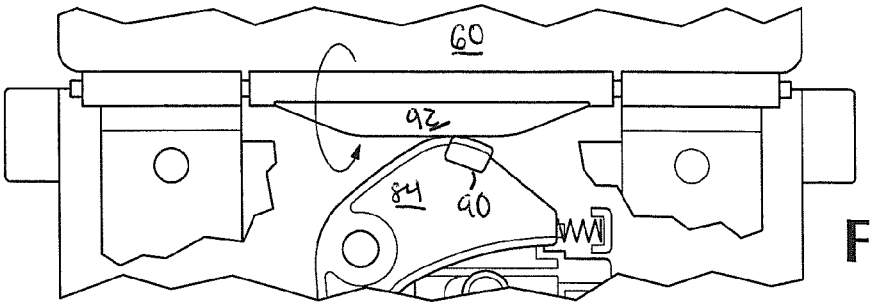
FIG. 6 is a partial view of the dispensing assembly of FIG. 4, showing compression of a lid against a portion of the release mechanism.
Figure 7:
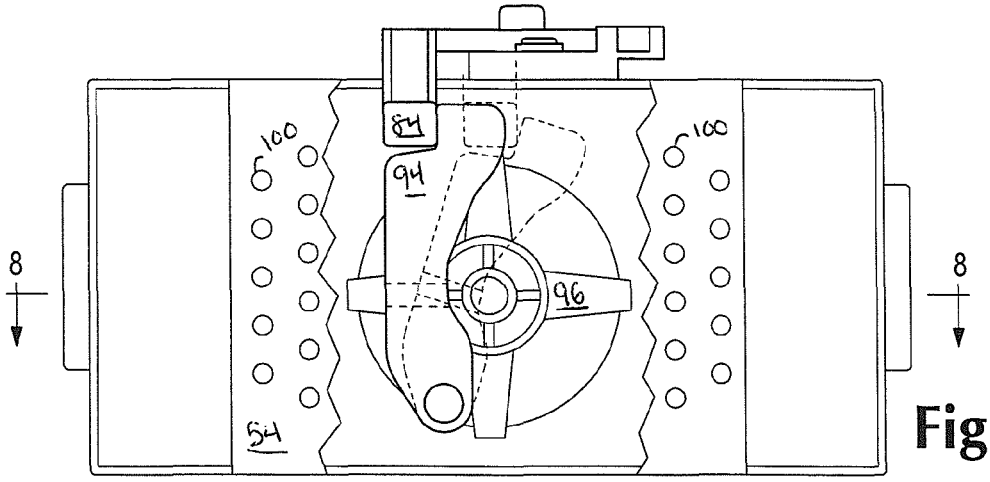
FIG. 7 is an underside view of the dispensing assembly of FIG. 4, showing a portion of the release mechanism and a portion of a cascade member.
Figure 8:
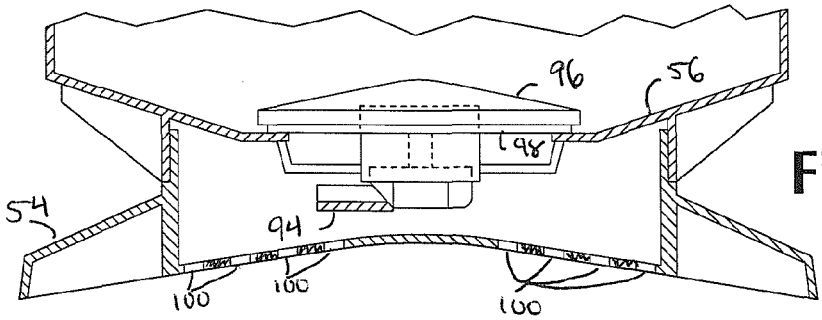
FIG. 8 is a section view of the dispensing assembly of FIG. 4, taken generally along line 8-8 in FIG. 7, showing a portion of the release mechanism and a release member in a closed position.

For example, a pivotable trigger arm 72, such as second support trigger arm 72*c*' may be in operable contact with a laterally moveable release element 82. Release element 82 may be biased by biasing member 83 and may releasably engage or lock with a first pivotable release arm 84 via hooks 86 and 88 (FIG. 4). Movement of pivotable second support trigger arm 72*c*' may cause dis-engagement of release element 82 and first pivotable release arm 84 (FIG. 5). Compression of a top portion 90 of first pivotable release arm 84 by a lid extension 92 may releasably re-engage or re-lock release element 82 with a first pivotable release arm 84 via hooks 86 and 88 (FIG. 6). This makes it easy for a child to reset release mechanism 80, because it is as simple as lifting and/or closing a lid on a container.

Figure 9:
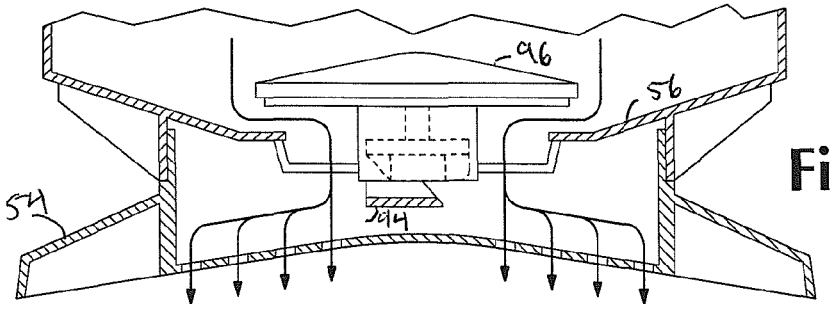
FIG. 9 a section view of the dispensing assembly of FIG. 4, taken generally along line 8-8 in FIG. 7, showing a portion of the release mechanism and a release member in an open position.

First pivotable release arm 84 may be in operable contact with a second pivotable release arm 94. Pivotable movement of second pivotable release arm 94 may impact against stopper 96 and may force stopper 96 from a closed position wherein fluid material can not escape dispenser 52 (FIG. 8) to an open position wherein fluid material (shown as arrows) is released from dispenser 52 (FIG. 9). Stopper 96 may include a rubber ring 98 to aid in forming a sealed closure in the closed position.

Cascade member 54 disposed below moveable stopper 96 may include perforations 100 in one or more areas such that fluid material released from dispenser 52 is falls through perforations 100. The number and size of the perforations 100 may be configured to prolong the release of water from dispenser 52, ensuring that some water may fall on a launched or moving toy vehicle despite distance from launcher 14. The cascade member 54 and/or perforations 100 may be configured such that water falling from tank 14 has a twin waterfall effect (FIG. 9).

As explained above, a particularly fun play pattern using playset 10 may include a thermochromic toy vehicle that changes color. For example, a user may decorate toy vehicle 200 with pen 44 to change selected portions of a thermochromic coating, and then launch the decorated vehicle under the water fall to change the colors of the vehicle yet again.

One or more elements of playset 10 may represent a human-like character, licensed character, copyrighted character, or any other suitable fantasy or real-life character or may represent a real-life or fantasy theme. For example, playset 10 may be configured to represent a garage wherein a user may rinse toy vehicle 200 or customize the color of toy vehicle 200 including hydro-chromatic or thermo-chromatic paint.

The various components of playset 10 may be fabricated from any suitable material, such as plastic, foamed plastic, flexible plastic, one or more layers of fabric, wood, cardboard, pressed paper, metal, or any combination of materials. A suitable material or combination of materials may be selected to provide a desirable synergy of weight, strength, durability, cost, and/or manufacturability. Several aspects of this exemplary method of game play may be modified from that disclosed above. Play may thus be configured to provide a game with a desired degree of complexity or difficulty, for example to adapt the game to players of a predetermined age range.

It is believed that the disclosure set forth above encompasses multiple distinct inventions with independent utility. While an example of each of these inventions has been disclosed in a preferred form, the specific examples thereof as disclosed and illustrated herein are not to be considered in a limiting sense as numerous variations are possible. The subject matter of the disclosures includes all novel and non-obvious combinations and subcombinations of the various elements, features, functions and/or properties disclosed herein. Similarly, where "a" or "a first" element or the equivalent thereof is recited, such usage should be understood to include incorporation of one or more such elements, neither requiring nor excluding two or more such elements.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope to the other claims, are also regarded as included within the subject matter of the present disclosure.

We claim:

1. A toy vehicle playset for a toy vehicle comprising:

a track assembly including a vehicle launcher operatively connected to a track defining a travel path;

a dispensing assembly configured to releasably retain a dispensable material, including a release mechanism positioned adjacent a portion of the track remote from the vehicle launcher; and a trigger assembly operably connected to the vehicle launcher and the release mechanism via one or more biased trigger members, wherein activation of the trigger assembly simultaneously activates the vehicle launcher and the dispensable material release mechanism;

wherein the track assembly is configured so that the simultaneous activation of the vehicle launcher and the release mechanism results in an interaction between a launched vehicle and a dispensed material at the remote portion of the track.

2. The toy vehicle playset of claim 1, wherein the release mechanism includes a moveable release member having an open position and activation of the trigger assembly simultaneously launches the toy vehicle and moves the moveable release member to the open position.

3. The toy vehicle playset of claim 2, wherein the trigger assembly includes a manually operable trigger adjacent the vehicle launcher and distal the moveable release member.

4. The toy vehicle playset of claim 2, wherein the dispensing assembly includes a tank and a support assembly for supporting the tank above the remote portion of the track, the tank having a bottom portion including the moveable release member.

5. The toy vehicle playset of claim 4, wherein the dispensing assembly includes a cascade member on the underside of the tank bottom portion, the cascade member configured to distribute the dispensed material released from the tank.

6. A toy playset for a thermochromatic toy comprising:

a toy launcher configured to launch a thermochromatic toy along a travel path;

a dispenser adjacent the travel path configured to releasably retain a color changing material; and a trigger operably connected to the toy launcher and the dispenser via one or more biased trigger members, wherein activation of the trigger simultaneously launches the thermochromatic toy along the travel path and releases the color changing material from the dispenser into the travel path, so that the thermochromatic toy and the color changing material interact along the travel path.

7. The toy vehicle playset of claim 6, wherein the dispenser is configured to releasably retain water.

8. The toy vehicle playset of claim 6, wherein the dispenser includes a tank and a support assembly for supporting the tank above the travel path.

9. The toy vehicle playset of claim 6, wherein the trigger is adjacent the toy launcher and distal the dispenser.

10. A toy vehicle playset for a toy vehicle comprising:

a track assembly including a vehicle launcher activatable to launch a toy vehicle, attached to a track defining a travel path for a toy vehicle;

a water dispenser assembly including a tank and a support assembly for supporting the tank above the track, the tank having a moveable release member at a bottom portion of the tank configured to release water; and a trigger assembly operably connected to the vehicle launcher and the moveable release member by at least one biased trigger member, wherein activation of the trigger assembly launches the toy vehicle and moves the moveable release member to an open position;

wherein the vehicle launcher and the moveable release member are configured to be activated simultaneously, and the track assembly is configured so that the simultaneous activation of the vehicle launcher and the moveable release member results in an interaction between the launched vehicle and the released water at a point along the track remote from the vehicle launcher.

11. The toy vehicle playset of claim 10, wherein the dispensing assembly includes a cascade member on the underside of the tank bottom portion, the cascade member configured to distribute water released from the tank.

12. The toy vehicle playset of claim 10, wherein the track is elevated above a work surface and the tank is supported above a first opening in the track.

13. The toy vehicle playset of claim 12, wherein the dispenser assembly includes a removable first reservoir positionable under the first opening in the track.

14. The toy vehicle playset of claim 13, wherein the removable first reservoir includes a handle and a curved lip portion configured for pouring water.

15. The toy vehicle playset of claim 12, wherein the track includes a second opening, the second opening sized such that the vehicle can pass through and a trapdoor movable between a closed position in which the trapdoor is positioned in the second opening and aligned with and forms a part of the track and an open position in which the trapdoor is removed from the second opening, the trapdoor being sized to support the toy vehicle when the trapdoor is in the closed position.

16. The play set of claim 15, further comprising a second reservoir disposed below the trapdoor for receiving a vehicle passing through the second opening when the trapdoor is in the open position.

17. The toy vehicle playset of claim 12, wherein the first opening in the track includes a splash guard.

* * * * *